United States Patent [19]

Klaus

[11] Patent Number: 4,558,811

[45] Date of Patent: Dec. 17, 1985

[54] NAIL DRIVING TOOL

[75] Inventor: Artur F. Klaus, Frankfurt am Main, Fed. Rep. of Germany

[73] Assignee: Signode Corporation, Glenview, Ill.

[21] Appl. No.: 588,094

[22] Filed: Mar. 9, 1984

[30] Foreign Application Priority Data

Mar. 11, 1983 [DE] Fed. Rep. of Germany ..... 3308630
Mar. 11, 1983 [DE] Fed. Rep. of Germany ..... 3308698

[51] Int. Cl.[4] ..... B25C 1/04; B25C 1/07

[52] U.S. Cl. ..... 227/116; 227/120; 227/126

[58] Field of Search ..... 227/109, 114, 115, 116, 227/120, 121, 125, 126, 130, 156

[56] References Cited

U.S. PATENT DOCUMENTS

| | | | |
|---|---|---|---|
| 3,238,983 | 3/1966 | Abrahamsen | 227/126 X |
| 3,266,697 | 8/1966 | Fiedler | 227/120 |
| 3,437,249 | 4/1969 | Baum | 227/120 |
| 3,688,966 | 9/1972 | Perkins et al. | 227/109 X |
| 4,126,258 | 11/1978 | Martin et al. | 227/109 X |

*Primary Examiner*—Paul A. Bell
*Attorney, Agent, or Firm*—Dressler, Goldsmith, Shore, Sutker & Milnamow, Ltd.

[57] ABSTRACT

The invention is concerned with a nail driving tool preferably operable in pneumatical manner, comprising a magazine for nails composed to form straight rows or straight strips, which nails are successively forced from the front end of a guide, possibly corresponding to the staggered arrangement of the nails, and obliquely terminating into a drive-out channel via a lateral inlet channel into a presenting composition for being, e.g., pneumatically forced out of the drive-out channel. For increasing the magazine capacity while maintaining a handy volume, it is provided that the magazine be formed as a box-type magazine of a width suitable for accommodating two or more nail strips or rows in side-by-side relationship and that the nail strips or rows can be successively forced in a direction normal to the planes of the nail strips or rows into alignment with the inlet channel of the drive-out channel.

13 Claims, 19 Drawing Figures

NAIL DRIVING TOOL

The present invention is concerned with a nail driving tool having a magazine for nails combined to form straight strips or rows, which nails from the front end of a guide possibly corresponding to a staggered arrangement of the nails and obliquely terminating via a lateral inlet channel into a drive-out channel are successively forced into a presenting position for being, e.g., pneumatically forced out of the drive-out channel.

In such a prior art nail driving tool, the magazine can respectively hold one single nail strip comprising a number of nails successively disposed in staggered relationship and interconnected by means of lateral paper or plastic strips. In order not to affect the handiness of the tool, the magazine must not exceed a predetermined length so that the magazine capacity is very limited. Hence, the nail strips will require a comparatively frequent replacement which will render difficult working with such a tool.

Moreover, nail driving tools are known in the art where the magazines are of a drum-shaped configuration and are adapted to accommodate 300 nails, or more. The nails with a plastic material strip or one or more steel wires, will have to be connected to an endless strip or reeled up to form a coil that is insertable into the drum magazine of the tool. Although such tools have a larger magazine volume than the aforementioned strip magazines, considerable disadvantages are involved with the coil magazines. Loaded with 300, or more nails, they have, e.g., a rather heavy weight and are not suitable for all users. The user has no choice to put a smaller number of nails into the magazine as, normally, only coils containing a predetermined number of nails are available. Another disadvantage involved with the drum magazine resides in that releading will be possible only with a fully used up coil. This fact, in practice, has proved to be extremely disadvantageous. If in nailing a prefabricated housewall or a workpiece of extended length, for example, 150 nailings are performed in series, with only 50 nails being contained in the drum magazine, the user will have to interrupt his work after 50 nailings, to return to the store place of the coils and to reload the tool, it is only after that that he can continue with his work. Also, loading of the drum magazine is an intricate work requiring more than a flick of the wrist. For example, it is not possible to lod a drum magazine without putting down the tool as opening of the drum magazine and the introduction of the front end of the coil strip into the carrier means will require both hands. In addition, drum magazines must be of a wide and jutting-out construction so that the tools frequently are not suitable for use at places of difficult access as the wide drum magazines will be impeding thereto.

It is the object of the invention to so improve a nail driving system of this type that it does not involve the disadvantages described in connection with drum magazines, but nevertheless has a higher magazine capacity.

That problem in accordance with the invention is solved in that the magazine is formed as a box-type magazine of a width suitable to accommodate two or more nail strips or rows in side-by-side relationship, and that the nail strips or rows can successively be forced normal to the planes of the nail strips or rows into alignment with the inlet channel of the drive-out channel.

A box-shaped magazine of this type equally can be loaded with 300, or more, nails in strip or row form, but need not necessarily be so, as the total load is respectively composed of comparatively short-length individual strips or rows of which a more or less large number can be introduced into the box-type magazine. If, for example, only a small number of nailings is to be performed on a workpiece, it might even be sufficient to isert a single nail strip. In that event, the heavy weight of a fully loaded box-type magazine need not have to be taken into account. Also, it is possible to perform intermediate reloads at any time by inserting, depending on the number of nailings still to be performed, one or more nail strips into the box magazine. Undesirable interruptions of a nailing operation caused by reloading requirements can be avoided in this manner. Reloading of a box-type magazine of the invention is very simple as the corresponding nail strips need only be inserted from the back into an opening of the box-type magazine. A complicated opening of the magazine or a threading of the strip into the carrier means are eliminated. The nail strips or rows as introduced during introduction into the box-type magazine inevitably are successively forced into the proper position in alignment with the inlet channel of the drive-out channel. It is not necessary for the box-type magazine of the invention to have a more extended length than the narrow insertable magazine hitherto customary for respectively one nail strip; only, they are wider, depending on the nail capacity to be accommodated. But on the whole they can still be kept so slender that the tool is also suitable for use at places of difficult access. The nail strips or rows in an advantageous embodiment of the subject matter of the invention are forced, for example, at least by one spring toward a stationary ramp face that is in alignment with the inlet channel of the drive-out channel. This will safeguard in simple manner the proper alignment of the respective nail strips or rows. After the first nail strip has been used up, the next one will respectively move up automatically to the proper supply position until the last nail strip has been used up.

In a simple embodiment of the tool of the invention, the magazine may be provided, for example, on the tool body in stationary manner and the ramp face can be formed by a sidewall of the magazine.

It will be possible in this connection for the nails to be guided with the points thereof in a manner abutting the tray of the stationary magazine, with the tray, feasibly, being adjustable in height so as to permit the use of nails of different lengths with the same box magazine.

The transport of the nail strips or rows in a special embodiment of the invention is effected in that at least one conveyor latch projects beyond the ramp face toward the interior space of the magazine that engages between the individual stems of the nails or backs up the respectively last nail of a nail strip or row directly forced against the ramp face. Hence, the nails of a nail strip in aligned position with the inlet channels of the drive-out channel can be advanced toward the drive-out channel by the conveyor latch.

The at least one conveyor latch feasibly gives way in resilient manner if a force is exerted thereupon from the loading end of the magazine while in the event of a force exerted in the opposite direction it remains projectingly arrested. This will involve the advantage that the nail strips, with no need for the latches to be retracted, can be readily inserted from the back into the box magazine along the ramp face while upon movement of the latches in the forward direction, the corresponding nail that has been backed up, will be entrained forwardly. Moreover, the latches by movement along the box magazine, are movable from a forward end position into a rearward end position where they can again back up a nail stem with no need of being retracted beforehand.

For a simple and efficient operation it is provided that the at least one latch is arranged on a conveyor cylinder operable in the longitudinal direction of the magazine externally of the ram face, e.g., by pneumatic means and/or by spring force.

The cylinder, feasibly, is blocked to prevent torsion about its axis so as to prevent an undesired disengagement of the respective latches from the nail stems.

The cylinder, feasibly, is displaceably disposed on a guide rod extending in parallel to the magazine.

Moreover, it can be pretensioned by displacement toward the rear magazine end against the action of a spring.

The displacement of the cylinder against the action of the spring, advantageously, is effected by the air pressure determined for driving out the nail, from a forward into a rearward end position. When the said air pressure drops, hence, the spring force can move the cylinder, the latch included, toward the front end of the box magazine thus forcing the foremost nail of the nail strip being in the stop position, into the drive-out position in the drive-out channel.

In a structurally particularly simple solution to the problem basic to the invention, the conveyor cylinder in a cylinder space in communication with the atmosphere includes a helical spring accommodated on the guide rod, which helical spring with the front end thereof is in abutment with an inner shoulder of the conveyor cylinder and, at the rear end thereof is in abutment with the circumferential shoulder of the guide rod.

A simple pneumatic operation of the conveyor cylinder is attained if the guide rod comprises a bore applicable to which is the operating air pressure of the working piston, with the bore terminating in a second sealed cylindrical space of the conveyor cylinder.

According to an embodiment of this suggestion, it can be provided that the air pressure in the second cylindrical space during driving out the respectively foremost nail is increased and after return of the driver blade forcing out the nail into the upper starting position is decreased again. Then the compression spring can push the conveyor cylinder again into its forward position.

The working stroke of the conveyor cylinder should at least be twice as large as the distance between two nails in the nail strip or row. This, on the one hand, involves the advantage that in the absence of a nail in the strip or row, a next nail nevertheless reaches the drive-out position. On the other hand, at the end of a preceding nail strip, the next one immediately follows so that there is no interruption of the nailing operation upon operation of the nail releasing key.

The aforedescribed features especially apply to nail strips and rows, respectively, the nails of which are disposed at such a space from one another that the latch can engage between the individual nail stems. In a special type of nail strips having a modified nail head, the nail stems with the nails arranged in staggered relation are, however, located directly adjacent one another so that it will not be possible for the latch to engage between the nail stems. In that event, a respective latch engages behind the backmost nail of a nail strip or a corresponding nail row that is just in the presenting position. In order to enable a latch always to do so, feasibly, two or more latches are provided in series in the longitudinal direction of the box-type magazine, and the working stroke of the conveyor cylinder, feasibly, is at least one nail strength greater than the distance from one latch to the next one lengthwise of the magazine.

In order to prevent the nail strip from being entrained backwardly during retraction of the latches into the new starting position, sweeping along the nail strip being in the presenting position, preferably, an unlockable blocking latch is provided for engagement behind the nail stem of a nail and the nail strip or row respectively abutting the ramp face. The said blocking latch prevents the respective nail strip or row from being displaced backwardly but, due to the capability of being unlocked, it also permits such a strip or row to be again removed from the box-type magazine.

Some type of prior known nail strips includes a number of nails obliquely disposed in staggered relationship and embedded in a comparatively thick plastic band. The said plastic strips are of such a width that the nail strip respectively abutting the ramp face over and on the following strip can be slidingly pushed forwardly with no mutual impediment of the nail heads which might occur with nail strips in which the nails disposed in staggered relationship are merely held together by paper strips laterally cemented thereon. In that event, it will be of a special advantage if the heads or points of the nails are accommodated in two or several guide grooves extending longitudinally of the magazine in a manner displaceable at a lateral space, which guide grooves are respectively adapted to be brought into alignment with the inlet channel of the drive-out channel. The space between the guide grooves is thus so dimensioned that adjacent nail strips or rows upon a relative displacement cannot impede one another. Such guide grooves not only are able to accommodate the known per se nail strips made up of interconnected nails, but are equally able to store single nails.

In order that the individual nail strips or rows despite the guide grooves be laterally displaceable for alignment with the outlet channel on the ramp face, it can be provided to bring the corresponding abutment edges of the guide grooves through their being moved away out of engagement with the abutting nail heads and nail points, respectively, so that the individual nail strips or rows automatically move up by spring action.

In an alternative embodiment of the inventive concept, it can also be provided that the magazine be displaceable with the guide grooves in full or a part comprising the guide grooves relative to the stationary magazine and normal to the plane of the guide strips and rows, respectively, toward the ramp face, e.g., by pretensioning means of a spring.

After the first nail strip and nail row, respectively, have been used up, the entire magazine, or the entire part comprising the guide grooves, will automatically move up by a distance corresponding to the lateral space of the guide grooves from one another, toward the ramp face so that the respectively next nail strip and the next nail row, respectively, gets into the presenting position with the ramp face.

In that embodiment, the laterally displaceable magazine can, for example, extend across a guide rail extending in the longitudinal direction of the magazine or can be guided in a different manner in its lateral displacement.

The conveyor cylinder can be disposed in a longitudinally displaceable manner in the guide rail.

The stationary guide rail, moreover, can form the ramp for the nails.

The conveyor cylinder in place of being supported on a helical spring disposed in a front cylinder space in the direction of the rear end of the guide rod with the rear end thereof can also support against a compression spring.

The guide rod in that form of embodiment, advantageously, in the longitudinal direction thereof is displaceably disposed on the tool body, and with the conveyor cylinder is moveable from a forward working position into a rearward releasing position. The guide rod at the rear end thereof can support on a compression spring so that after the movement has taken place, it will automatically be forced again into the front working position. Secured to the conveyor cylinder, directly or indirectly, is a tow hook embracing the nail respectively contained in the drive-out channel. In the displacement of the guide rod along with the conveyor cylinder toward the rearward box magazine end the nail strip inclusive of the nail already contained in the drive-out channel is thereby at the same time retracted so that the said nail strip can be easily removed from the box magazine.

The tow hook in the retracting position, feasibly, blocks a release locking mechanism provided on the nozzle so that the tool cannot be released when the nail strip is withdrawn.

An embodiment of simple construction of the tool according to the invention is attained if the laterally displaceable magazine is guided on a guide column extending transversely of the nail strip planes and through a compression spring disposed on the guide column is forced toward the ramp. In this manner, the respectively next nail strip automatically is given the proper position relative to the drive-out channel after the respectively preceding nail strip has been used up.

The laterally displaceable magazine, in its starting position in which the nail strips or rows are insertable into the magazine, can be arrested against the action of the compression spring thereby permitting an easy reloading with no need for the magazine to be manually held in this loading position against the action of the compression spring.

The magazine as a whole or the art comprising the guide grooves can be exchangeably held on the tool body. This will permit to successively provide a magazine already filled, or a groove plate already filled, on the the tool.

The part comprising the guide grooves can be formed as a plate-shaped packing profile adapted to be inserted into the magazine. This will permit a particularly easy reloading.

The plate-shaped packing profile can, for example, be formed as a one-piece plastic profile which will permit an easy production involving the advantage that the nails can easily glide into the guide grooves toward the drive-out channel.

The guide grooves, preferably, are formed of a T-shaped cross section, with the nail head being received in the cross bar of the T, and with the portion of the nail stem immediately following the nail head being received in the leg of the T so that the respective nail to a high degree is secured against lateral movement.

Moreover, an unlockable arresting latch backing up the rear end of the packing element can be provided on the tool of the invention, which latch will safely prevent an undesired slipping of the packing element out of the box magazine from occurring.

The various objects, aspects and advantages of the present invention will be more fully understood from a consideration of the following description of embodiments of the invention by way of the enclosed drawings. In this connection, it should be noted that all described and/or illustrated features by themselves or in any reasonable combination form the subject matter of the invention irrespective of the summarization thereof in the claims or the dependence thereof.

In the drawings

Figure 1:
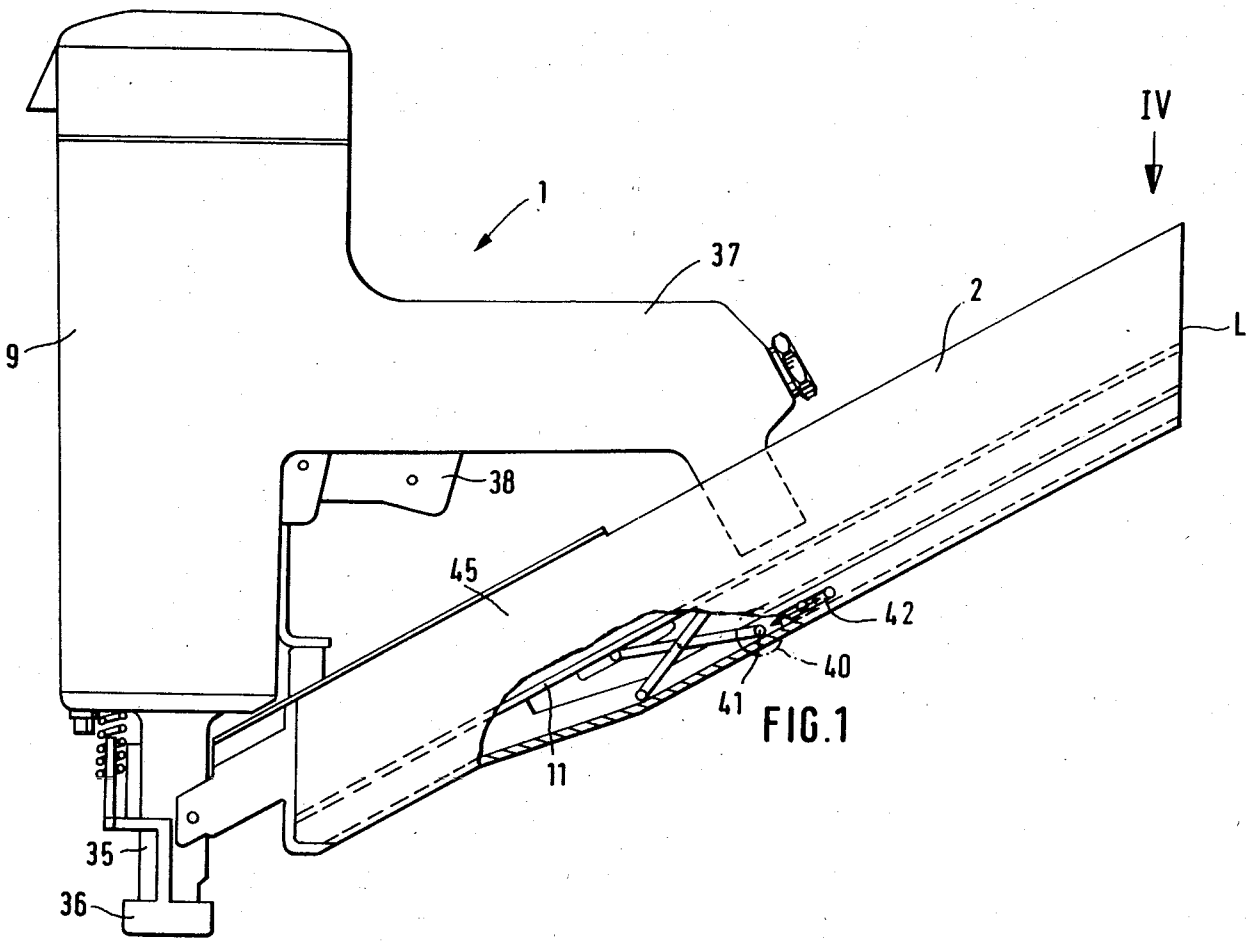
FIG. 1 is a side view, partially broken away, of a first embodiment of a nail driving tool according to the invention.
Figures 2, 3:
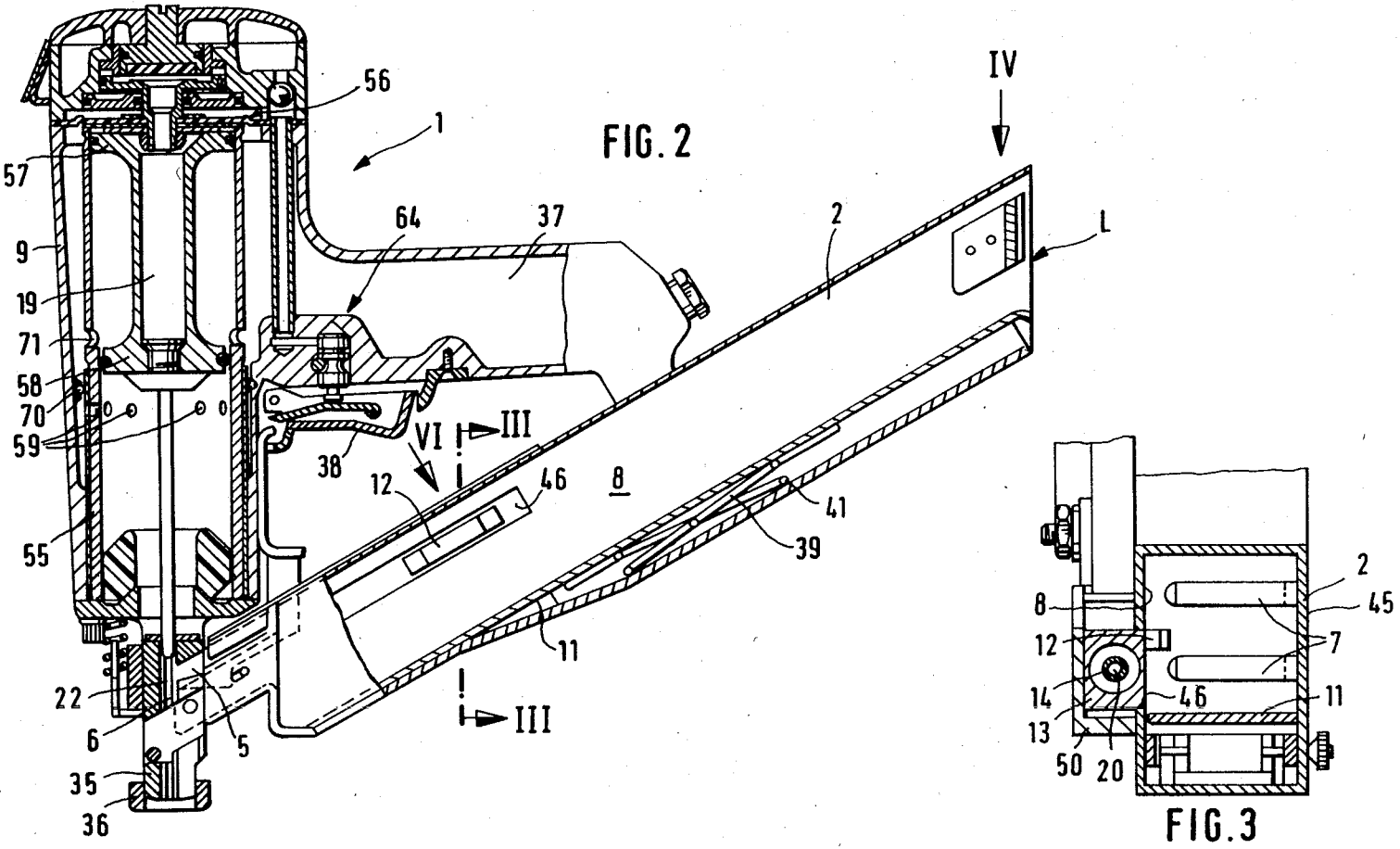
FIG. 2 is a view of the tool according to FIG. 1, partly in section.
FIG. 3 is a sectional view along the line III—III of FIG. 2, of the box magazine according to the invention.
Figure 4A:
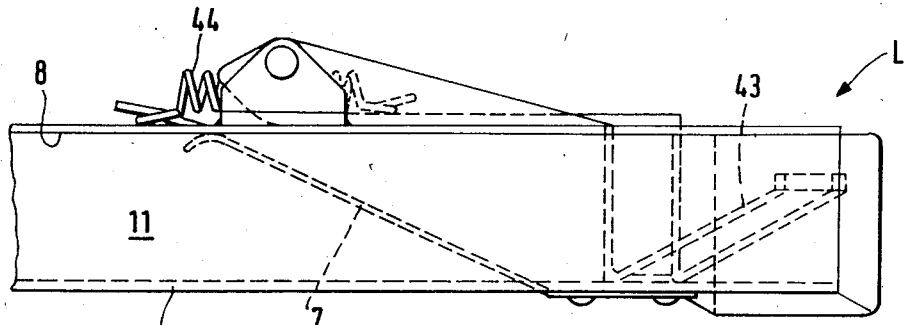
Figure 4B:
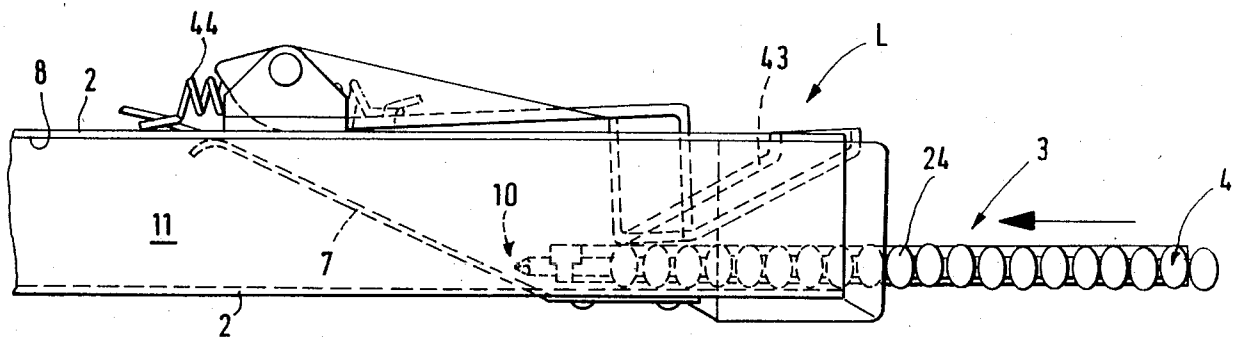
Figure 4C:
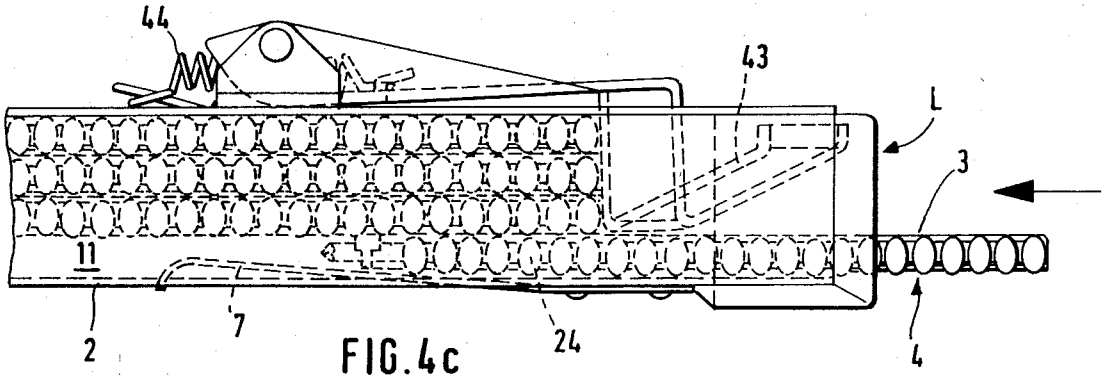
Figure 4D:
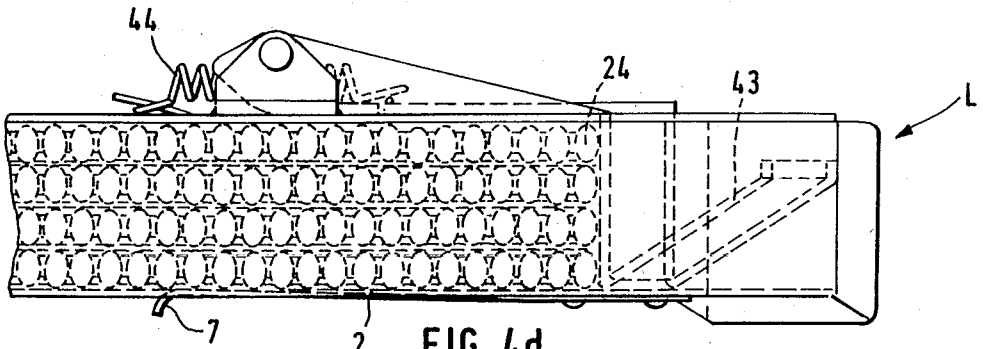
Figure 5:
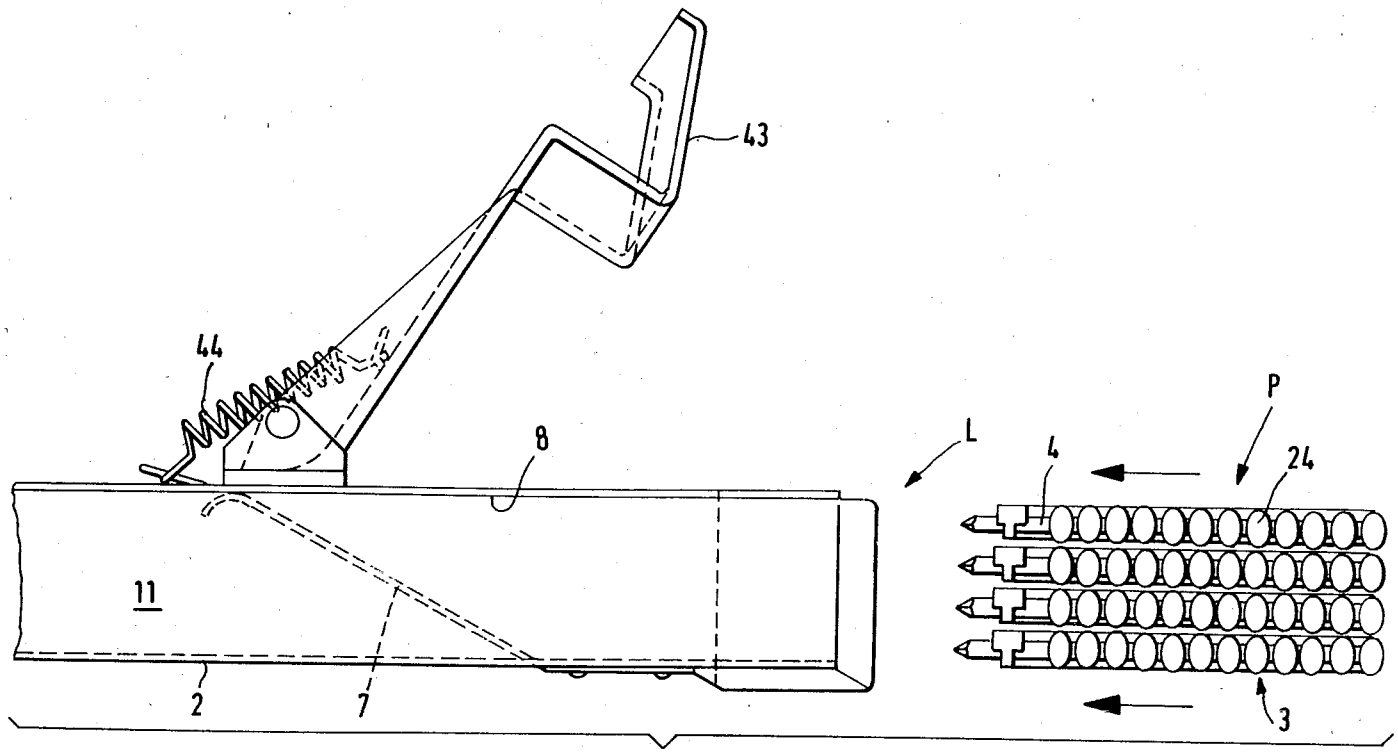
Figure 6:
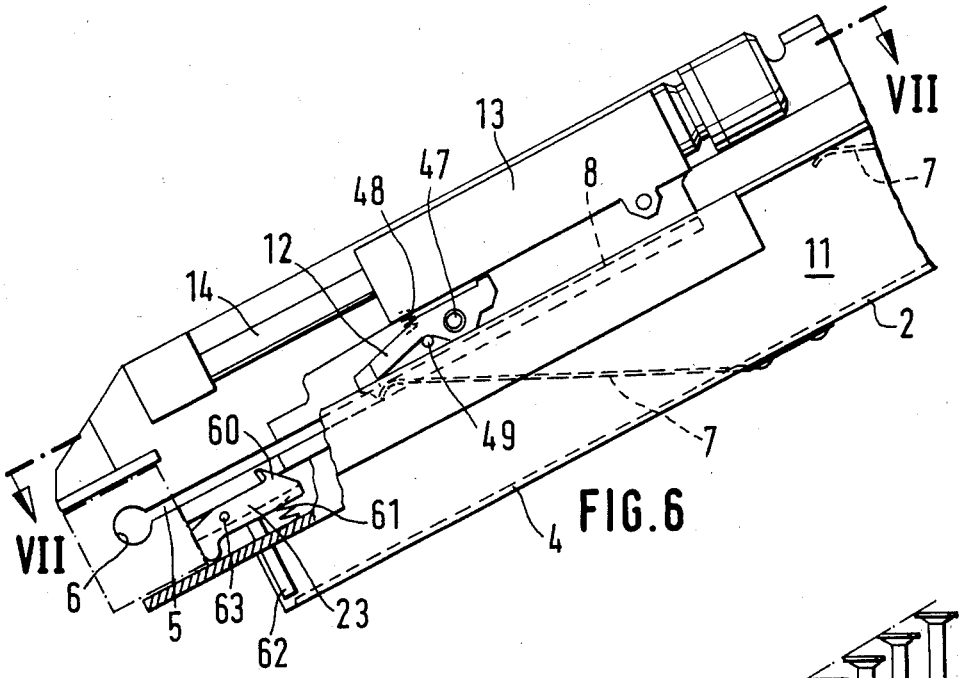
Figure 8:
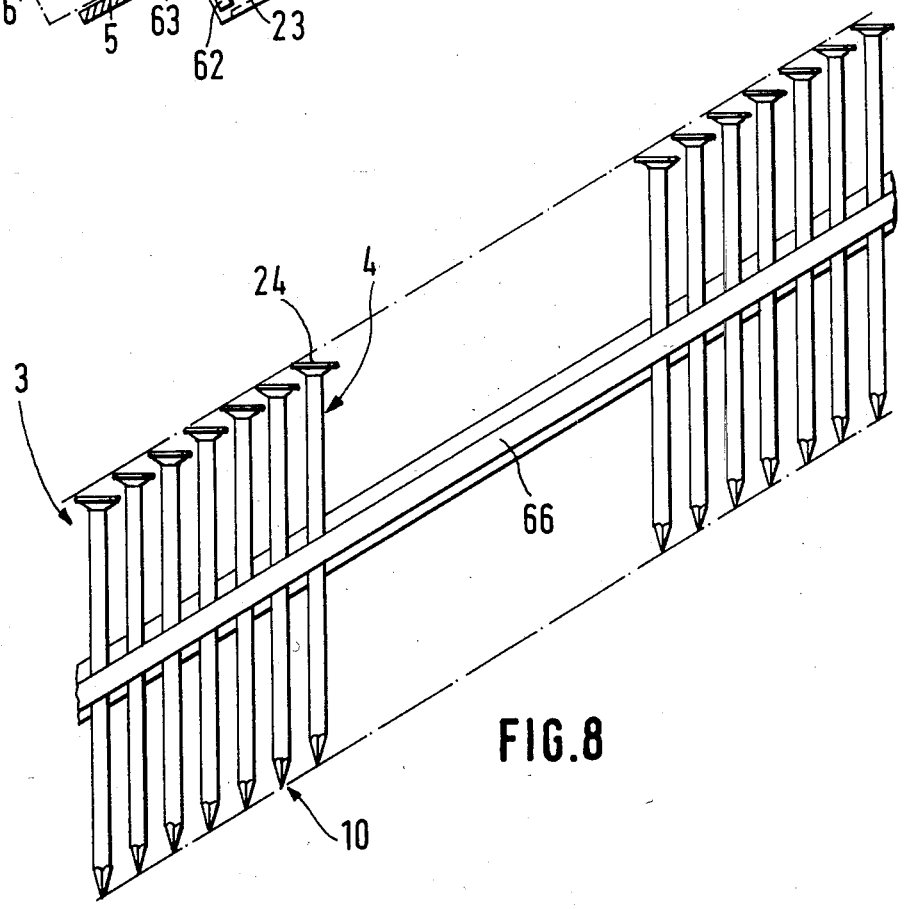
Figure 7A:
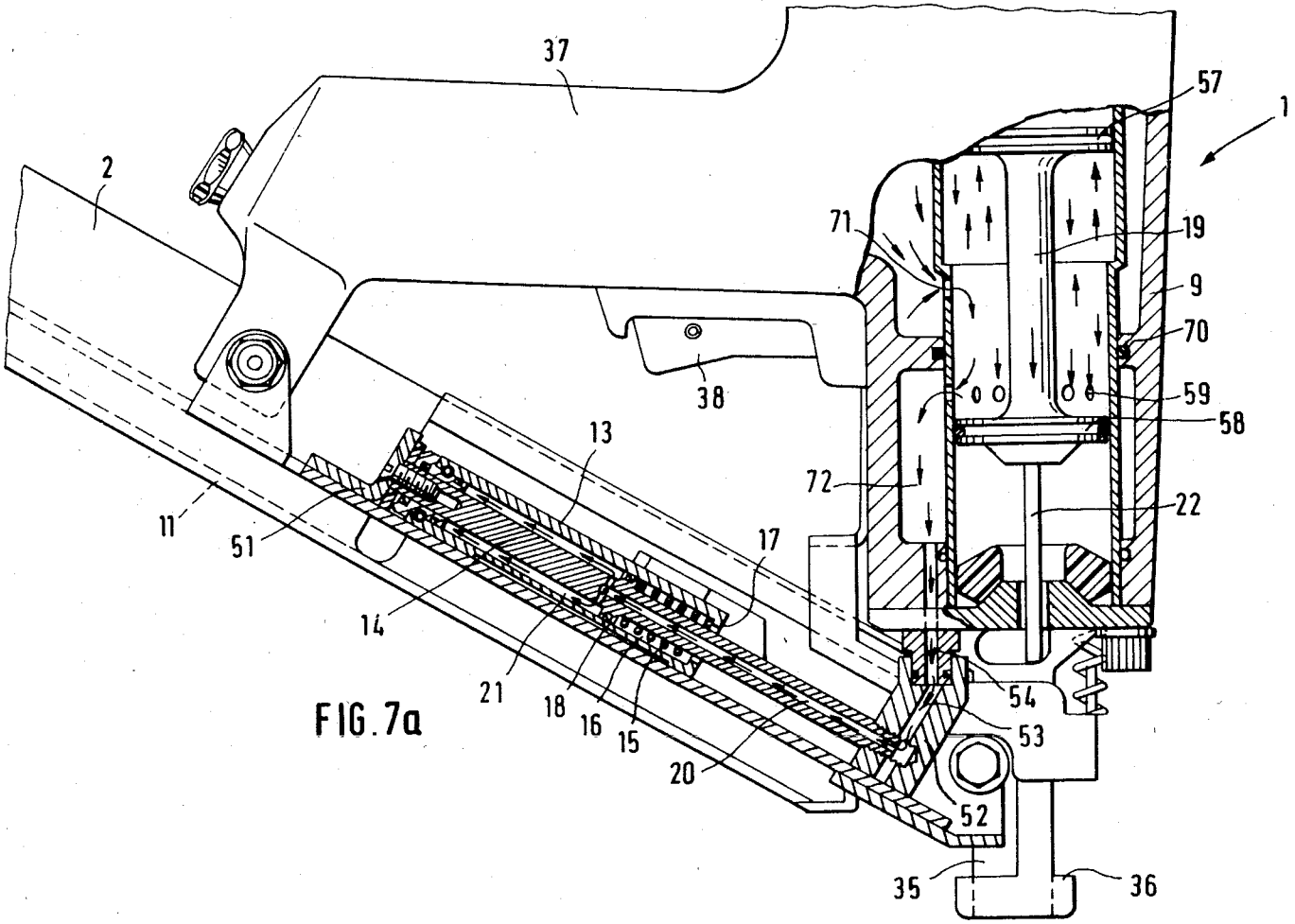
Figure 7B:
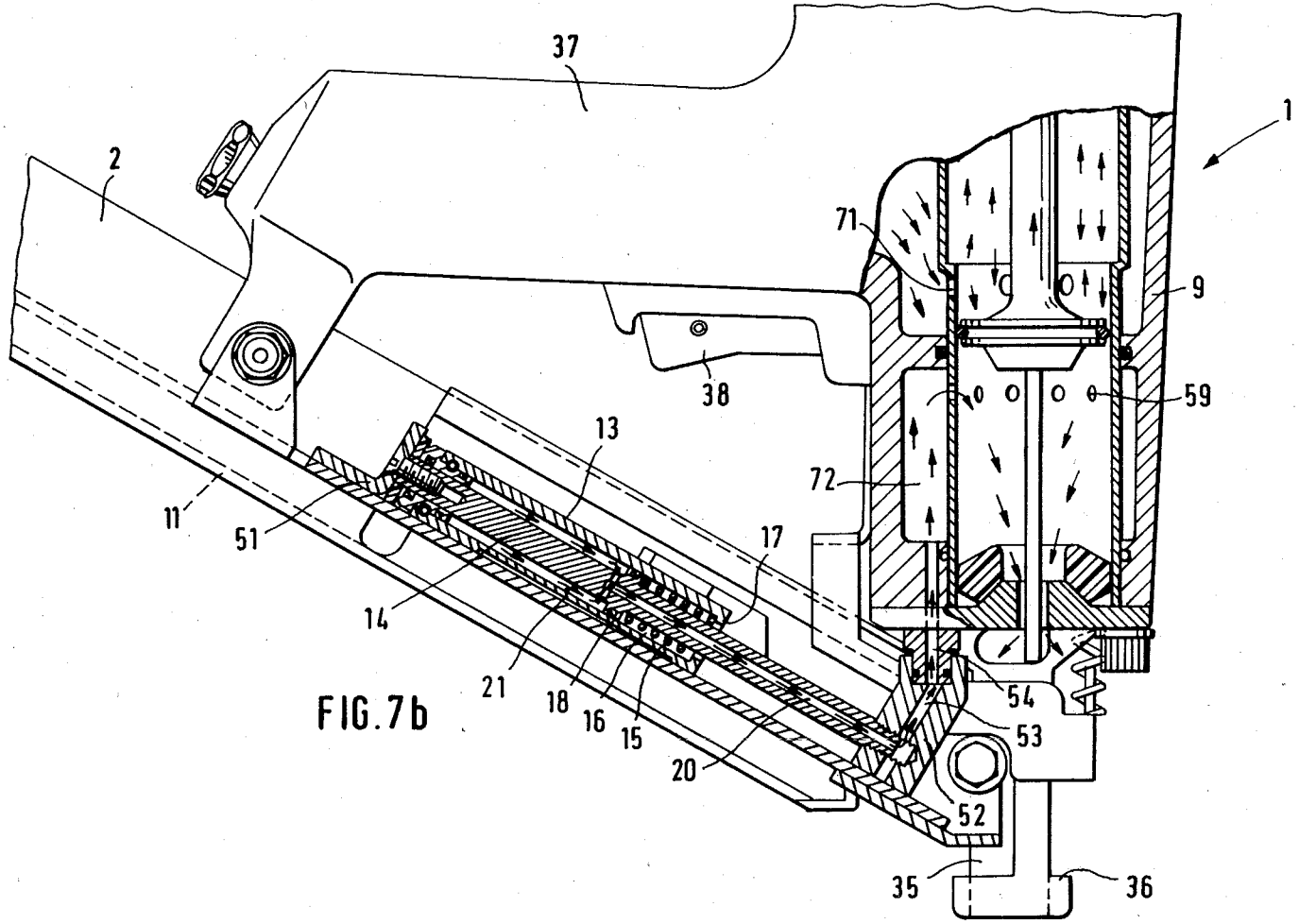
Figure 9:
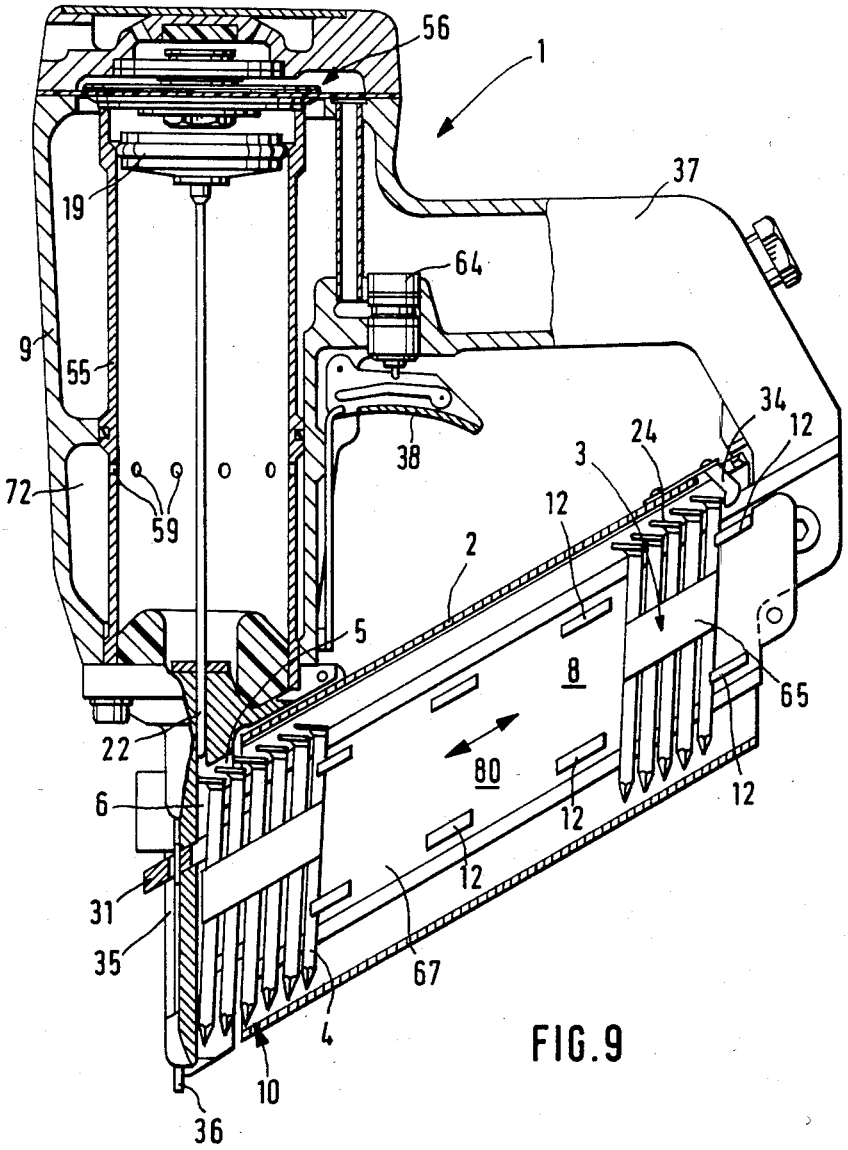
Figure 10A:
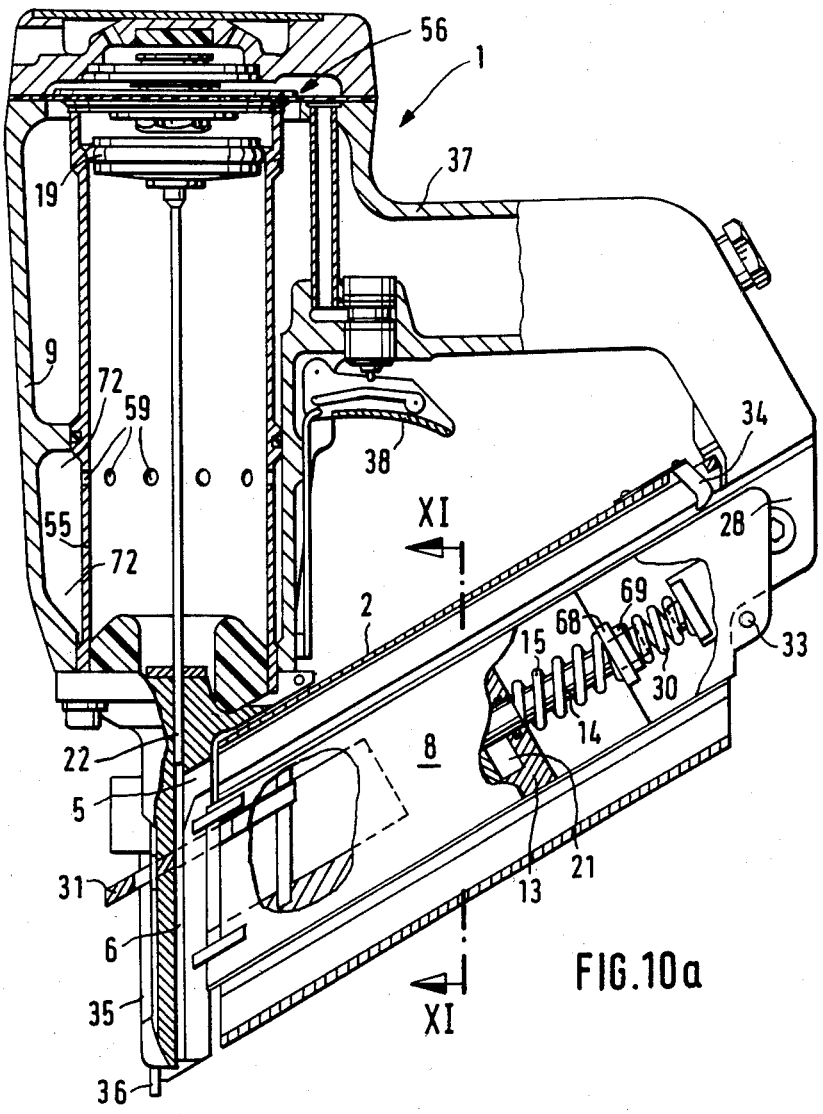
Figure 10B:
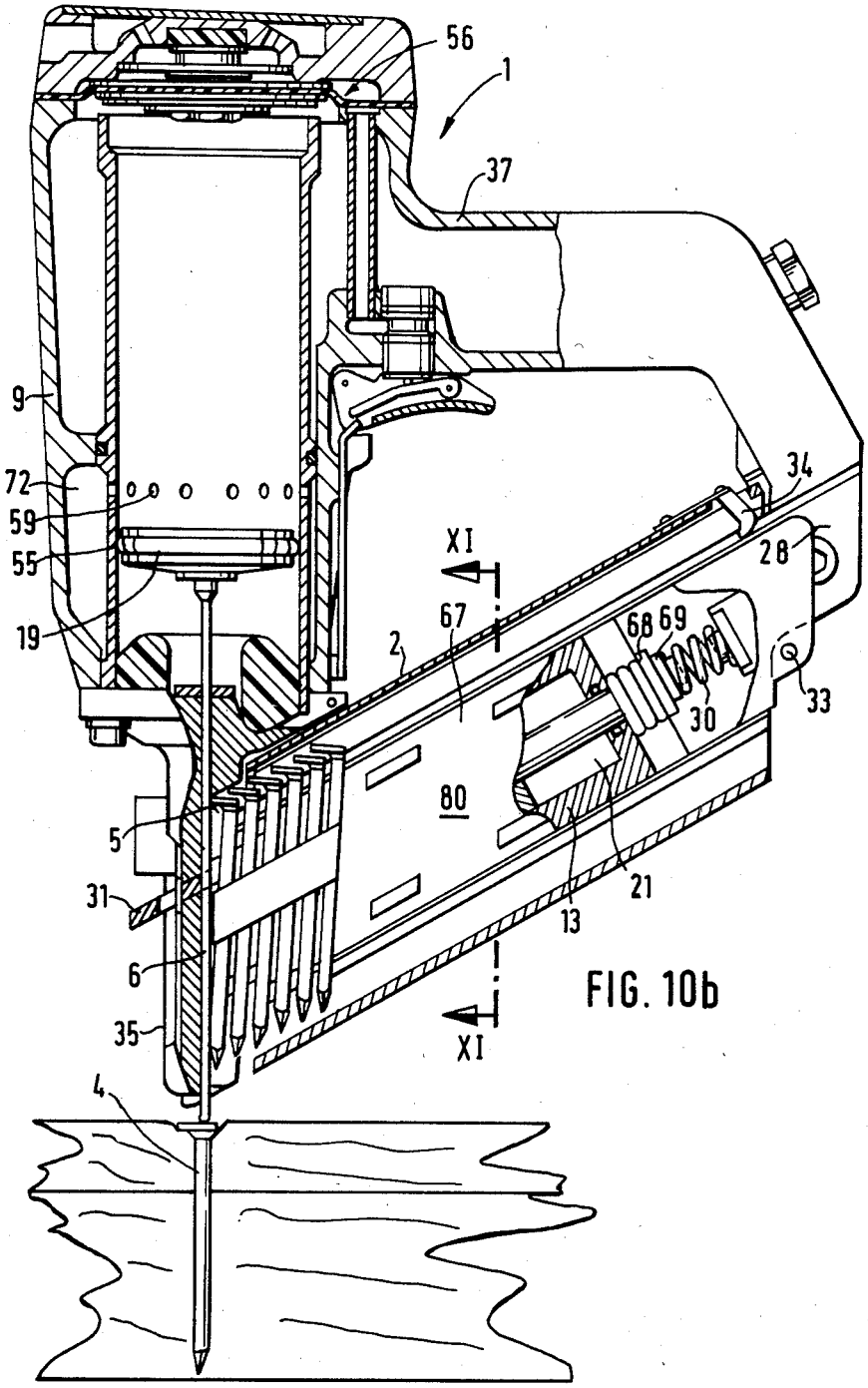
Figure 11:
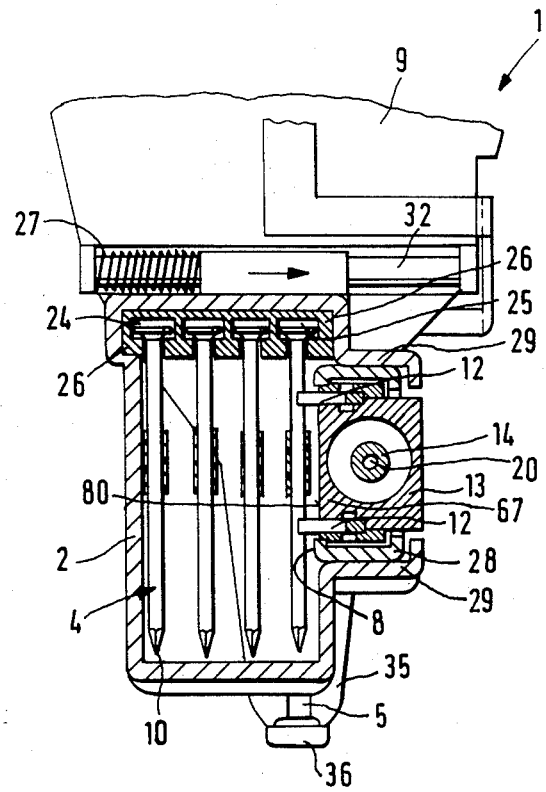
Figure 12:
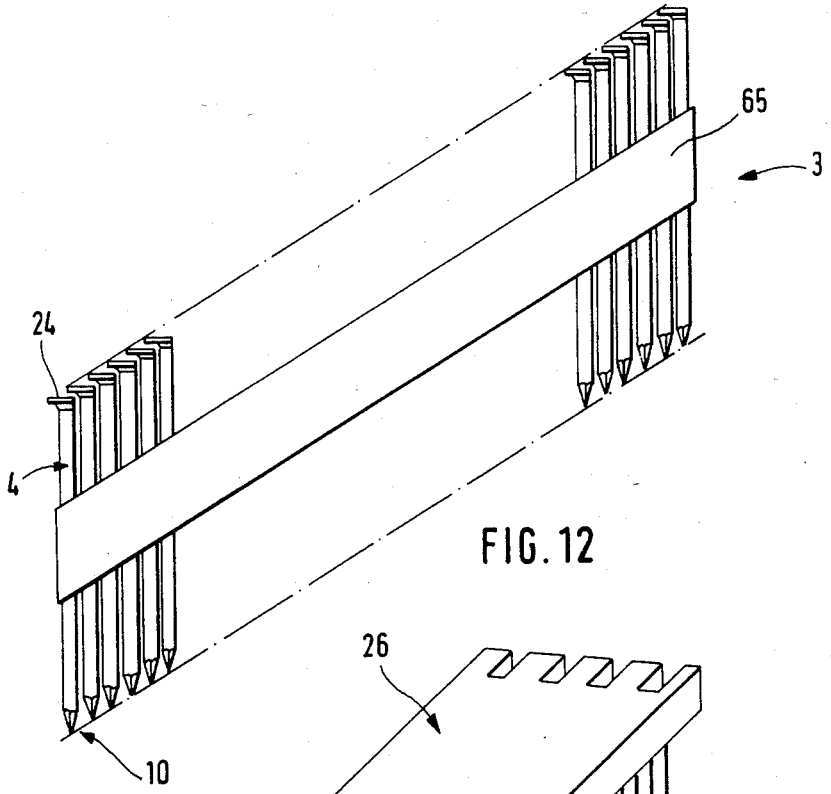
Figure 13:
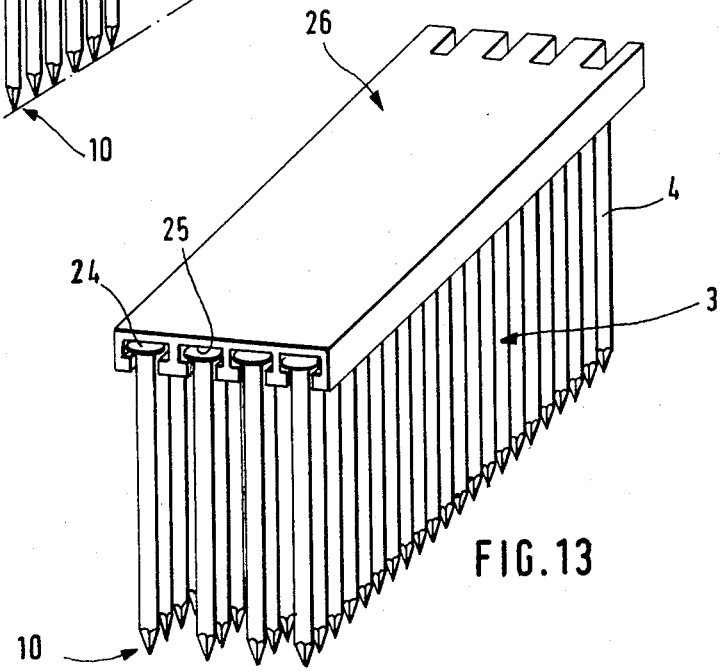
Figure 14:
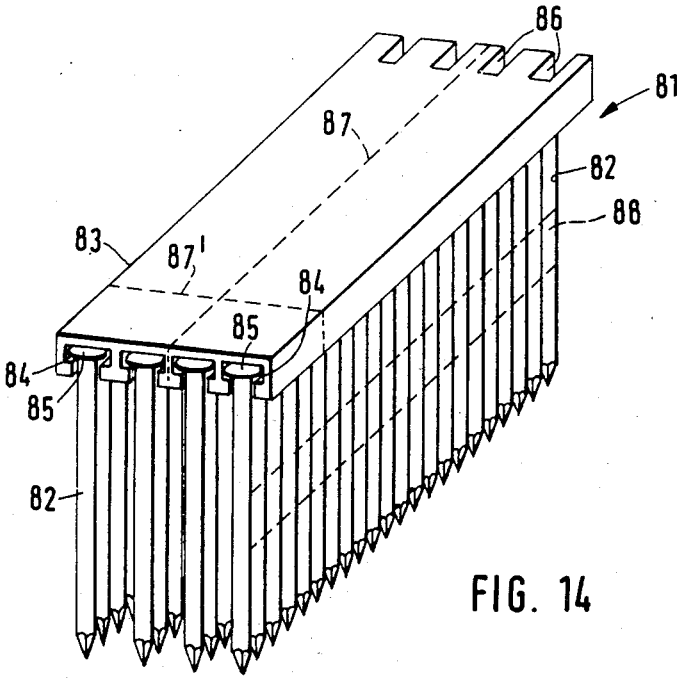

FIGS. 4*a* through 4*c* are plan views along line IV—IV of FIGS. 1 and 2 of the rear end of the box magazine according to the invention into which are successively inserted single nail strips until the magazine is fully loaded;

FIG. 5 is an illustration corresponding to FIG. 4 except that nail strips combined to form a pack are inserted into the box magazine from the rear;

FIG. 6 is a plan view of a conveying means for the nail strips and rows, respectively, viewed from VI of FIG. 2;

FIGS. 7*a* and 7*b* are longitudinal sections taken along the sectional line VII—VII of FIG. 6, showing two different positions of the working piston;

FIG. 8 is a side view of a nail strip that is especially suitable for use in a nail driving tool according to the embodiments as shown in FIGS. 1 through 7;

FIG. 9 is a sectional view of another embodiment of a nail driving tool of the invention as shown in FIG. 2;

FIGS. 10*a* and 10*b* are views corresponding to the one of FIG. 9, except that in the area of the box magazine, the nail strip has been omitted and parts have been broken away to better show the conveyor means for the nail strips, showing two different positions of the working piston;

FIG. 11 is a sectional view along line XI—XI of FIG. 10, except that the individual nail strips with the nail heads are displaceably accommodated in guide grooves of a guide plate;

FIG. 12 is a side view of a nail strip having a lateral paper connecting band suitable for use with a tool of the invention as shown in FIGS. 9 to 11, i.e., one provided with guide grooves;

FIG. 13 is an oblique view of a nail packing unit containing a plurality of nail rows stored in side-by-side relationship in guide grooves of a holding plate, which, as a whole, is insertable into a box magazine of the tool according to the invention according to the embodiments shown in FIGS. 9 through 11; and FIG. 14 is an oblique view of a nail magazine unit similar to the one illustrated in FIG. 13.

The embodiment of the nail driving tool 1 according to FIGS. 1 through 7 is especially suitable for nail strips 3 according to FIG. 8 wherein a number of nails 4 with the aid of a relatively thick plastic material strip 66 are interconnected. The strength of the plastic material strips 66, normally, is so dimensioned that the adjacent nail strips 3 can support thereon and can displaceably slide against one another in the longitudinal direction, with the nail heads not getting tangled.

The nail driving tool 1 according to FIGS. 1 through 7 comprises a tool body 9 having a nozzle 35 to be directed to the workpiece and a laterally projecting handle 37 having a manual trigger 38 which, however, can become operable only if a locking lug 36 displaceably disposed on nozzle 35 by placing tool 1 onto the workpiece has been retracted. When then operating the manual trigger 38, a working piston 19, having an upper piston flange 57 of larger diameter and a lower piston flange 58 of smaller diameter, is then pneumatically forced from its retracted position into an advanced position. Working piston 19 on the front face thereof is provided with a driver blade 22 terminating with the front tip thereof into a drive-out channel 6 driving therefrom a nail 4 in the presenting position out of nozzle 35 into the adjacent workpiece. Secured between nozzle 35 and handle 37 is a box-shaped magazine 2 corresponding to the staggered arrangement of nails 4 of the nail strips 3 to be accommodated by magazine 2. From magazine 2, the respectively next nail 4 of a nail strip 3 via a lateral inlet channel 5 in drive-out channel 6 can be forced into the presenting position. Magazine 2 is of a width that permits accommodation therein of a plurality of nail strips 3 in side-by-side relationship. Magazine 2 at the bottom thereof has a tray 11 adapted to be raised and lowered by a scissor-type mechanism 39, which tray by means of a knurled screw 40 the axis 41 of which along a slot 42 is displaceable in the sidewall of magazine 2, is variable and adjustable in height so that tray 11 is adjustable to the respective length of nails 4 to be worked. Moreover, magazine 2 at the rear loading end L thereof (see FIGS. 4 and 5) includes a gate 43 adapted to be opened against the action of a spring 44 for the insertion of nail strips or rows 3 preventing an undesired drop of the nail strips or rows 3 out of magazine 2 from occurring. The inner face of the sidewall 8 of magazine 2 which, viewed from the user, is the righthand one, is so arranged that, being the ramp, it is in alignment with the inlet channel 5 of the drive-out channel 6 of nozzle 35. The sidewall of magazine 2 which, viewed from the user, is the lefthand sidewall, is provided with a plurality of leaf springs 7 of such a configuration that their sense of force extends toward the righthand sidewall 8 so that a force is always exerted upon nail strips or rows 3 inserted into the magazine 2 thereby displacing the same toward the righthand sidewall 8. The righthand sidewall 8 includes an opening 46 extending longitudinally of magazine 2 through which can extend one or more conveyor latches 12 and between which are engageable the nail stems of nail strips 3 directly forced to the righthand sidewall 8. Conveyor latches 12 are pivotably disposed about an axis 47 in such a manner that upon a force acting from the loading end of magazine 2 against the action of a spring 48 they resiliently get out of the path of movement of the nail strip or nail row 3, whereas upon action of a force in the opposite direction, i.e., in a thrust upon a nail stem toward the drive-out channel 6, they remain projectingly arrested. A stop pin 49 serves as an end support for the action of the force of spring 48. Conveyor latches 12 over axis 47 are secured to a conveyor cylinder 13 which externally of the righthand sidewall 8 is displaceable in parallel to magazine 2 on a guide rod 14. Conveyor cylinder 13 by an angle 50 is locked against torsion about its axis. Guide rod 14 with the rear end thereof by means of an angle 51 is screwed to magazine 2, whereas at the front end thereof, it is inserted into a bearing member 52 on nozzle 35. In a front cylinder space in communication with the atmosphere, a helical spring 15 is disposed about guide rod 14. At its front end, it is supported on an inner shoulder 17 of conveyor cylinder 13 and at its rear end it is supportd on a circumferential shoulder 18 of guide rod 14. Helical spring 15 thus forces the conveyor cylinder 13 in non-aerated condition into a forward end position. A rear cylinder space 21 of the cylinder 13 is sealed against guide rod 14 and via a bore 20 of guide rod 14 and a bore 53 of the bearing member 52 is in communication with an air conduit 54 terminating into the lower space of the working cylinder 55, sealed above a bore row 59 outwardly by seal 70. If the nail driving tool is connected to a compressed air source, also, the space between the upper and the lower piston flanges 57, 58 of working cylinder 19 is filled with compressed air. If through operating manual trigger 38 and locking nose 36 a driving operation is released, main valve 56 opens and working piston 19 is forced downwardly by the compressed air penetrating into working cylinder 55 (FIG. 7*a*). The foremost nail 4 being in the presenting position in drive-out channel 6 is forced thereby into a workpiece. The lower piston flange 58 of working piston 19 traverses the bore row 59 provided in the lower working cylinder area so that the compressed air entered between the upper and the lower piston flanges 57, 58 of working piston 19 through an opening 71, via an outer chamber 72, air conduit 54 and bores 53 and 20 reaches the rear cylinder space 21 and conveyor cylinder 13 is displaced in parallel to the longitudinal direction of magazine 2 to the back. Through a pawl 23 provided on nozzle 35 (see FIG. 6) nail strip 3 abutting sidewall 8 is prevented from moving backwardly with the backward movement of conveyor latch 12. Pawl 23, with an arresting tooth 60 is forced by springs 61 into an interval between two adjacent nail stems. Pawl 23 is pivotable about a stationary magazine axis 63. Against the action of springs 61, arresting tooth 60 by means of an unlocking pin 62 can be manually brought out of engagement with nail strip 3 so that the same can be extracted out of magazine 2 to the back. After the return movement of the conveyor cylinder 13 under the action of the air pressure against the force of spring 15, conveyor latch 12 at the end of the working stroke engages between two nail stems of nail strip 3 abutting sidewall 8. If as a result of a reverse of the valve 64 and of the main valve 56, the compressed air above the working piston 19 is discharged to the atmosphere, the working piston 19 will return into its upper end position (FIG. 7*b*). This will also cause the compressed air collected in the rear cylindrical space 21, via bore 20, bore 53, air conduit 54, outer chamber 72, and bore row 59, as shown in FIG. 7*b*, to escape to the atmosphere so that cylinder 13 under the action of compression spring 15 contained in the front cylindrical space 16 will be forwardly displaced, thereby transporting to the front also nail strip 3 via latch 12 and permitting a new nail 4 to automatically reach the presenting position of the drive-out channel 6. That operation is repeated until the entire nail strip 3 abutting the sidewall 8 of the box magazine 2 has left the magazine area toward nozzle 35 whereupon, under the action of the leaf springs 7 provided on the lefthand sidewall 45 of magazine 2, the subsequent nail strip 3 is pushed toward the righthand sidewall 8 of magazine 2 so that the nail strip gets into engagement with latch 12 provided on cylinder 13. Thanks to the fact that the working stroke of conveyor cylinder 13 covers at least the twofold distance of two nails in nail strip 3 the remainder of the preceding nail strip 3 that is already outside the box magazine 2 and underway to drive-out channel 6 is caught up by the subsequent nail strip 3 so as to permit a continuous nailing until magazine 2 is completely empty or at the user's discretion is reloaded during working. This means a special advantage involved with the nail driving tool 1 of the invention.

FIGS. 9 through 11 show another embodiment of a nail driving tool 1 according to the invention which is especially suitable for working of nail strips 3 according to FIG. 12 or nail arrangements according to FIG. 13. Nail strip 3 according to FIG. 12 is distinguished from the one as shown in FIG. 8 in that on account of a modification of nail head 24, nails 4 disposed in staggered and immediately adjacent relationship, are connected to a lateral adhesive tape 65, whereas nails 4 according to FIG. 8 are seated in a relatively thick plastic connecting material strip 66 keeping adjacent nail strips 3 in magazine 2 at an adequate space in order to prevent them from tangling in a relative displacement. However, this would be possible with nail strips 3 according to FIG. 12 as nail heads 24 protrude beyond the outer faces of the adhesive tapes 65 a comparatively long distance. While nail strips 3 according to FIG. 8 with the nail points 10 can be guided on tray 11 adjustable in height of stationary magazine 2 in the embodiments according to FIGS. 9 through 11 a guide of nails 4 with nail head 24 in guide grooves 25 is provided at a distance. As the nail stems here are disposed in close relationship, a conveyor latch 12 cannot engage an interval. It is, therefore, provided that respectively the last nail 4 of a nail strip 3 is seized by a latch 12 to thereby supply nail strip 3 to the nozzle 35. Provided on conveyor cylinder 13 is a slide element 67 facing the interior of the magazine which slide elements forms a ramp 80 and with a multiplicity of latches 12 protruding therefrom in a manner distributed along the length of magazine 2 so that, during transport, a latch 12 or a pair of latches always backs up the last nail 4 of a nail strip 3. The working stroke of cylinder 13, for this purpose, is greater by at least one nail strength than the space of one latch 12 from the next latch 12 in the longitudinal direction of the magazine.

The nail driving tool 1 according to FIGS. 9 through 11 operates in a manner similar as the one described in FIGS. 1 through 7 having a working cylinder 55, a main check valve 56, a finger valve 64, a working piston 19 and a driver blade 22 secured thereto that is guided in drive-out channel 6 in which a nail 4 is respectively kept ready in order to be driven into a workpiece upon release. Magazine 2 is equally formed in box-type manner, but in that case is kept transversely displaceable on a guide rail 28 extending longitudinally of magazine 2, with rail 28 having a lateral projection 29. Guide rail 28 at the front end is secured to nozzle 35 and at the rear end is secured to handle 37 of the tool body 9. Displaceably disposed in guide rail 28 is cylinder 13 carrying on the side facing the interior of the magazine sliding member 67 having the ramp 80 with latches 12 disposed in pairs. Latches 12, as in the first form of embodiment, upon the action of a force in the conveying direction, in a resiliently escaping manner, whereas upon the action of a force in the direction of the rear end of magazine 2 remain arrested in a manner projecting into the interior space of magazine 2. Conveyor cylinder 13 is again displaceably disposed on a piston rod 14 along magazine 2 that passes through conveyor cylinder 13. The front part of guide rod 14 is accommodated in a longitudinally displaceable manner in a fitting piece secured to guide rail 28. Central bore 20, bore 53, air conduit 54 connect the outer chamber 72 to a cylindrical space 21 for displacing cylinder 13 against the action of helical spring 15 against which cylinder 13 is supported with the rear end thereof, and which with the opposite end thereof is adjacent an elbow 68 in which is slidingly disposed guide rod 14. Guide rod 14 behind elbow 68 secured to guide rail 28 is provided with a projection 69 formed as a spring hanger on which is seated a compression spring 30 forcing guide rod 14 into the conveying direction, whereas compression spring 15 forces piston 13 in non-aerated condition into its forward end position. If by operating finger valve 64 an opening of main valve 546 is caused, working piston 19 is driven downwardly through the air flowing above into the working cylinder 55 so that nail 4 contained in drive-out channel 6 is driven out into a workpiece (FIG. 10*b*). Working piston 19 shortly before reaching its lower end position traverses a row of openings 59 contained in working cylinder 55 so that compressed air provided above working piston 19 via an O-ring acting as a non-return valve can get into the storage chamber for the reverse stroke of the working piston 19. Thus, in the manner already described above, compressed air equally reaches cylindrical chamber 21 of cylinder 13 so that cylinder 13 and movable sliding element 67 connected thereto with latches 12 are forced against the action of compression spring 15 into the rearward position. Nails 4 contained in magazine 2 as a result of being pressed (to be explained in the following) to ramp 80 are so held that latches 12 cannot move nail strip 3 backwardly. If movable sliding element 67 with latches 12 has reached the rearward end position, respectively, a pair of latches 12 will back up the last nail in that the plate of cylinder 13 exceeds the space from latch 12 to latch 12 in the longitudinal direction of the magazine by at least one nail strength. In a reversal of the tool, working piston 19 is displaced into the upper end position by the air therebelow penetrating out of the cell for the return stroke into working cylinder 55. If working piston 19 has reached the upper end position, also the air pressure therebelow will decrease so that the air in cylinder 13 can equally escape. Cylinder 13 and slide element 67 secured thereto with latches 12 under the action of compression spring 15 will be displaced toward nozzle 35, thereby equally displacing the next forward nail 4 of nail strip 3 into drive-out channel 6.

Magazine box 2 preferably made of extruded aluminum in transversely displaceable manner is disposed on a guide column that is stationary relative to tool body 9. By way of a compression spring 27 disposed on guide column 32, magazine box 2 is shifted to a side which, viewed by the user, is the righthand side, toward guide rail 28. In an upper extending area of magazine box 2, a sectional portion 26 having guide grooves 25 open at the bottom is inserted between the inner face of the cover of magazine box 2 and the upper edge of guide rail 28. Guide grooves 25 of plate-shaped section 26 in cross section are T-shaped for receiving nail strips and rows 3 with nail heads 24. Section 26 is preferably made of plastic material so that nail heads 24 are easily slidable in guide grooves 25 and can be easily entrained by latches 12 in the direction of conveyance. An arresting latch 34 provided on the rear end of magazine box 2 prevents nail strip 3 and nails 4 of a nail row, respectively, and section 26, respectively, from dropping from behind the magazine box 2. Moreover, with the aid of an arresting mechanism (not shown) magazine box 2 in the starting position which, viewed from the user, is the left one, can be fixed against the action of compression spring 27. In that position, it is possible for the user to load the T-shaped guide grooves 25 with nail strips 3—in the instance illustrated with four nail strips 3. After relieving the arresting mechanism, the first nail strip 3 facing the sliding element 67 is backed up by the latches 12 and upon operation of the tool is fed stepwise to the drive-out channel 6. After the first nail strip 3 has been used up, magazine box 2 is automatically fed further to the right toward movable element 67 and the next nail strip 3 is seized by latches 12. If magazine 2 is to be reloaded, the movable sliding element 67 with the aid of a handling bolt 33 secured to the rear end with guide rod 14 against the action of spring 30 can be drawn backwardly to such an extent that a tow hook 31 secured to the front end of the sliding element 67 is moved backwardly, with hook 31 embracing the nail 4 already contained in the drive-out channel 6 and retracting the same into magazine 2. In this manner, magazine 2 in the way already described can be shifted to the left thereby permitting reloading of the T-shaped guide grooves 25 already vacant with nail strips 3. After unlocking magazine box 2 from this loading position, the work can be continued. Here, too, a continuous reloading of magazine 2 is possible in a simple manner.

In place of inserting from the back individual nail strips 3 into section 26 contained in magazine 2, it will also be possible for section 26 already fully loaded with nails 4, as shown in FIG. 13, to be substituted in full for an emptied section 26 of magazine 2. The separate section 26 according to FIG. 13 in that instance has thus no nail strips, but rather nail rows 3 for nails 4 of which it will not be imperative to be interconnected in the longitudinal direction, but they may be so interconnected. Section 26 with pre-magazined nails 4 hence is a novel nail packing unit permitting a rapid and complete loading of a magazine 2 both with nail strips 3 and with a field of individual nails 4. For loading of section 26 with non-magazined nails 4, a separate loading mechanism may be provided that can be in operation while the inventive nail driving tool 1 is being used. Section 26 has a nail receiving capacity that approximately corresponds to the capacity of nail strip package P of FIG. 5 and completely fills the interior of magazine 2.

The nail magazine unit 81 for nails 82 illustrated in FIG. 14 is similar to the one illustrated in FIG. 13 and includes a substantially rectangular, plate-shaped holding element 83 of plastic material. Moreover, on the bottom side thereof it includes in the embodiment as illustrated four grooves 84 of T-shaped cross section that extend in parallel with respect to one another. Nails 82 are accommodated in grooves 84 in rows with heads 85 thereof. Such a unit comprising holding element 83 and nails 82 in matrix-type arrangement is suitable for a simple, rapid and complete loading of a box-shaped magazine of a nail driving unit. The ends of grooves 84 during production of the packing unit can be closed on both ends to thereby prevent nails 82 from dropping out. Shortly before inserting the nail magazine unit 81 into a box-shaped magazine of a nail driving tool the front end of grooves 84 can be ripped or cut apart. Especially this will be possible if the closure is in the form of an adhesive tape or in the form of a thin plastic wall integrally formed with holding element 83. Provided on the rearward end of the plate-shaped holding element 83 are a plurality of recesses 86 for engagement of a safety latch of the nail driving tool to prevent an undesired dropping out of the box-type magazine from occurring. As shown in broken lines, holding element 83, moreover, can include weakened material lines 87,87' extending in the longitudinal and/or transverse directions, along which the nail magazining unit 81 can be subdivided into minor sub-units if so desired.

It is apparent that holding element 83 not only is suitable for receiving individual, non-magazined nails 82, but also for receiving nail strips already pre-magazined in the form of strips as shown on the nail row on the extreme righthand side in the drawing by a connecting strip 88 illustrated in broken lines.

What is claimed is:

1. A nail driving tool comprising a drive channel, a driver reciprocably slidable in said channel for driving nails directed thereto into a workpiece, and a magazine defining a channel cooperating with said drive channel through which successive nails are fed into said drive channel to be contacted by said driver during each cycle of operation of said driver, means for feeding successive nails from said magazine into said drive channel, said magazine being stationarily disposed relative to said tool and having a width suitable for receiving two or more parallel rows of nails and defining a surface against which the nail rows are forced, said surface being formed by a sidewall of the magazine, and means for biasing the rows of nails in a direction normal to the planes of the nail rows against a surface disposed in alignment with the cooperating channels of the drive tool and magazine and defined by one of said magazine or driving tool, pneumatically operated latch means disposed adjacent the row of nails being fed into the drive channel and positioned to engage the nail row to move a nail into position beneath the driver for repetitive driving of said nails into a workpiece, said latch means are constructed and arranged to move in one direction to positively move nails into the drive channel but are permitted to move in the reverse direction free of said nail row, the latch means comprises at least one latch adjacent the surface and provided on a conveyor cylinder pneumatically operable in the longitudinal direction of the magazine and, if the nails of the nail rows are disposed at a space from one another that the latch can engage between the individual stems, the working stroke of the conveyor cylinder being twice as large as the distance between two nails in the nail row, and, if the nail stems in the nail row are located directly adjacent one another so that it is impossible for the latches to engage between the nail stems, then a respective latch engages behind the backmost nail of a nail row and at least two latches are provided in series in the longitudinal direction of the magazine, the working stroke being at least one nail length greater than the distance from one latch to the next one lengthwise of the magazine whereby a row of nails is in alignment with the cooperating channels of said magazine and driving tool and successive nails from the rows of nails are fed into said drive channel until the magazine is emptied.

2. A tool according to claim 1, characterized in that at least one latch, with a force exerted upon the same from the loading end of the magazine, resiliently gives way, while with a force exerted in the opposite direction, it remains protrudingly arrested.

3. A tool according to claim 1, characterized in that at least one latch protrudes beyond the sidewall of the magazine toward the interior space of the magazine, with the latch engaging between the individual nails or backing up the respectively last nail of a nail strip or row directly forced onto the sidewall.

4. A tool according to claim 1, characterized in that the cylinder is blocked to prevent torsion about the axis thereof.

5. A tool according to claim 1, characterized in that the cylinder is displaceably disposed on a guide rod extending parallel to the magazine.

6. A tool according to claim 1 including an unlockable pawl for backing a nail of the nail strip or row respectively abutting the sidewall.

7. A tool according to claim 1, characterized in that the cylinder is disposed in longitudinally displaceable manner in the guide rail.

8. A tool according to claim 1, characterized in that the guide rail forms a ramp for the nails.

9. A tool according to claim 1, characterized in that secured to the cylinder directly or indirectly, is a tow hook embracing the nail contained in the drive-out channel.

10. A tool according to claim 9, characterized in that the tow hook in the retracted position blocks a release locking nose provided on the tool.

11. A tool according to claim 1 in which part of the magazine is movably disposed relative to said tool and the surface against which the nail rows are forced is formed by a guide defined by said tool at the sidewall of the stationary part of the magazine.

12. A tool according to claim 1 in which the tool contains a support member for said magazine means movably supporting said magazine relative to the support member and means resiliently biasing said magazine relative to said support member, whereby a row of nails will be continuously biased against said surface to position a row of nails thereagainst so nails will be successively driven into position relative to said driver to be driven thereby.

13. A tool according to claim 12 in which the magazine includes a member defining a plurality of guide grooves parallel to each other in a longitudinal direction of the magazine and supporting the rows of nails by their heads, and means for resiliently biasing said member against the surface in alignment with the cooperating channels of the drive tool and magazine, whereby a row of nails will be continuously biased into position so that individual nails will be continuously fed into position to be driven by said driver.

* * * * *